United States Patent [19]

Manor

[11] 4,441,388

[45] Apr. 10, 1984

[54] HAND TOOL LINKAGE

[75] Inventor: Henry A. Manor, Detroit, Mich.

[73] Assignee: Balmar Crimp Tool Corp., Orlando, Fla.

[21] Appl. No.: 316,046

[22] Filed: Oct. 28, 1981

[51] Int. Cl.[3] ..... B25B 7/06

[52] U.S. Cl. ..... 81/300; 81/416; 30/191

[58] Field of Search ..... 81/300, 415–417, 81/341, 302; 30/190–192, 250–252, 266; 72/409; 29/268; 74/469

[56] References Cited

U.S. PATENT DOCUMENTS

| | | | |
|---|---|---|---|
| 611,537 | 9/1898 | Ward | 81/416 |
| 1,267,133 | 5/1918 | Smith | 81/416 |
| 2,168,812 | 8/1939 | Van Keuren | 81/302 |
| 3,091,841 | 6/1963 | Wurzel | 81/416 X |

*Primary Examiner*—Frederick R. Schmidt
*Assistant Examiner*—Debra S. Meislin
*Attorney, Agent, or Firm*—Harness, Dickey & Pierce

[57] ABSTRACT

A linkage apparatus for a pair of relatively pivotal elements, such as the pivotal jaws of a hand tool, preferably includes at least a pair of linkage members pivotally interconnecting the pivotal elements. Each of the preferred linkage members is pivotally pinned to the pivotal elements and includes elongated apertures therein for receiving and supporting the pivot pins of the other linkage member.

13 Claims, 5 Drawing Figures

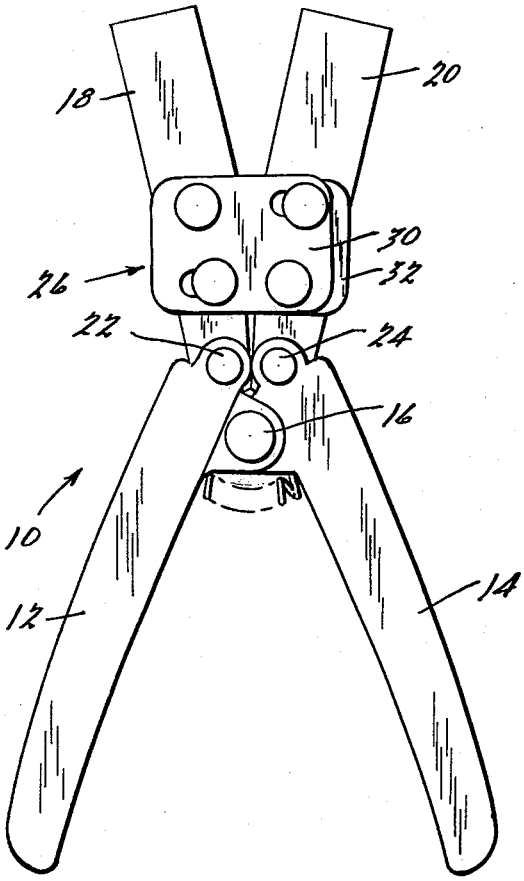
FIG. 1.
FIG. 2.
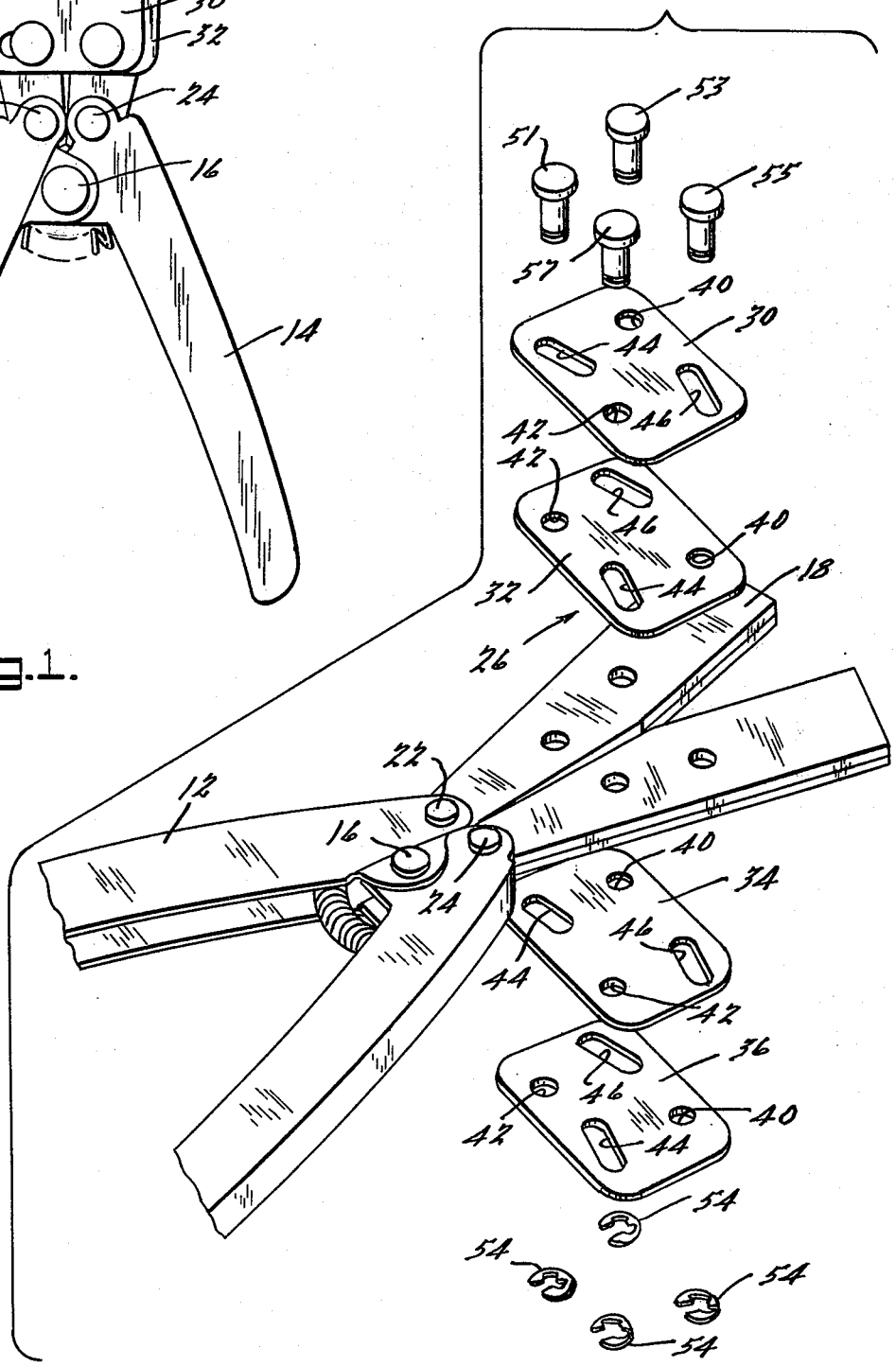

HAND TOOL LINKAGE

BACKGROUND OF THE INVENTION

The invention relates generally to improvements in tools and more particularly to such tools having pivotal jaws or lever members. Tools of this type typically include hand-actuated devices such as pliers, grippers, spreaders, crimpers and the like. Such tools often include a pair of cross links pivotally attached to the jaws or attached to both the jaws and handles by pivot pins for imparting pivotal motion to the jaws in order to perform an operation on a workpiece. An example of such a tool is illustrated and described in U.S. Pat. No. 2,168,812.

Because each cross link in the above-described tools pivots on both of the jaws, they necessarily cross and slidably engage each other. As a result, one of the cross links in such previous tools is rotatably attached to its pivot pins in a plane that is offset relative to the plane of movement of the other cross link and to the plane of movement of the jaws. Because of such offset relationship, when the jaws engage a workpiece and a force is applied to the levers to perform the required operation, the reaction forces on the pivot pins cause an unbalanced bending moment in a plane perpendicular to the plane of motion of the jaws. Such reaction forces can also cause other undesirable effects such as stress concentrations at or about the cross link pivot pins and possible misalignment of the working surfaces of the jaws.

The present invention preferably includes at least one pair of linkage members pivotally interconnecting a pair of jaws or levers of a tool for spreading or closing the jaws in order to perform work on a workpiece. Each of the linkage members is pivotally attached to both jaws preferably by means of a pin member extending therethrough. Each linkage member includes apparatus for supporting and reinforcing the pin members of the other of the linkage members, thereby tending to balance the reaction forces imparted to the pin members as a result of the jaws acting on the workpiece.

The preferred supporting apparatus includes elongated openings in a portion of each linkage member for receiving therein the pin members of the other linkage member. The pin members move within the elongated openings as the jaws are pivoted and preferably engage the peripheral edges of the elongated openings at least when the jaws operatively engage the workpiece.

In one embodiment of the invention, at least one of the linkage members is integrally incorporated into one of the jaws or levers of the tool. Another preferred embodiment includes at least two pairs of linkage members preferably with an equal number of the linkage members being pivotally connected to each side of the jaws.

BRIEF DESCRIPTION OF THE DRAWINGS

FIG. 1. is a side view of a hand tool with its jaws in the open position, including linkage apparatus embodying the present invention.

FIG. 2 is a partially exploded perspective view of the hand tool of FIG. 1.

DETAILED DESCRIPTION OF THE PREFERRED EMBODIMENTS

Figure 3:
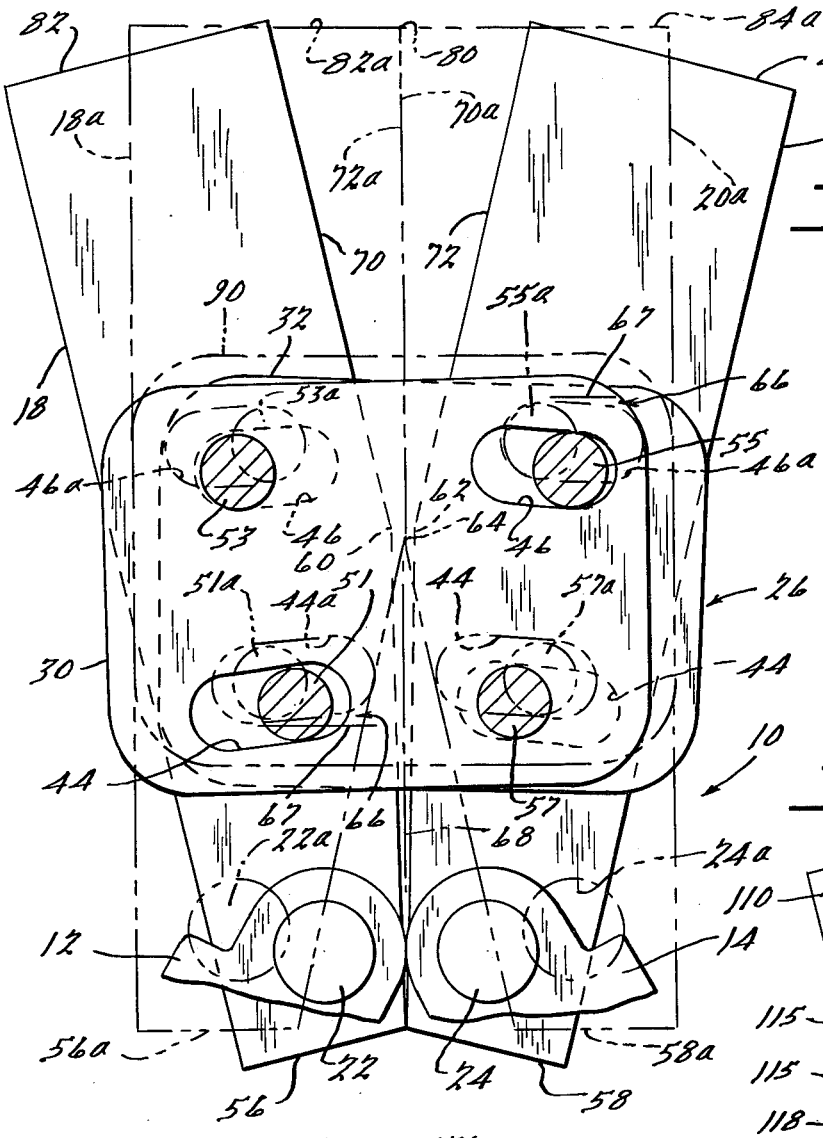
FIG. 3 is an enlarged side view of the jaw portion of the hand tool of FIG. 1, with the closed-jaw and open-jaw positions of the various components of the hand tool indicated by broken lines and solid lines, respectively.

Referring to the drawings, wherein common elements are indicated by common reference numerals, FIG. 1 illustrates a hand tool 10 including a pair of handles or actuating levers 12 and 14 pivotally interconnected by a pin 16. The handles 12 and 14 are pivotally connected to jaw members 18 and 20, respectively, by pins 22 and 24 extending therethrough. The jaw members 18 and 20 are shown in an open position in FIG. 1 and are connected for relative pivotal motion preferably by a linkage assembly, generally indicated by reference numeral 26. The hand tool 10 of FIG. 1 is shown in the drawings and described herein for purposes of illustration only. One skilled in the art will readily recognize from the following description that the invention is not so limited, but is equally applicable to other types of hand tools, as well as other types of devices or mechanisms, having elements connected for relative pivotal motion.

Referring to FIGS. 1 and 2, the preferred linkage assembly 26 includes a first pair of linkage plates 30 and 32 and a second pair of linkage plates 34 and 36 disposed on opposite sides of jaw members 18 and 20. All of the linkage plates 30, 32, 34 and 36 are preferably identical with the linkage plates 30 and 31 oriented in a reversed relationship relative to the linkage plates 32 and 36. Each of the preferred linkage plates 30, 32, 34 and 36 includes a pair of diagonally-opposed pivot apertures 40 and 42 and a pair of diagonally-opposed guide openings, or elongated apertures, 44 and 46 therethrough. The first pair of the linkage plates 30 and 32 are mounted face-to face on one side of jaw members 18 and 20 in a mutually slidable relationship as are the second pair of linkage plates 34 and 36 on the opposite side of jaw members 18 and 20. Similarly, the opposite faces of the linkage plates 32 and 34 slidingly engage the outer side faces of jaw members 18 and 20, respectively. A set of four linkage pins 51, 53, 55 and 57 preferably protrude through the pivot apertures 40 and 42 and the guide openings or elongated apertures 44 and 46 and are pivotally received within jaw apertures in the jaw members 18 and 20, respectively. In the preferred embodiment, the linkage pins 51, 53, 55 and 57 are engaged and retained by a set of resilient retaining members 54.

In FIG. 3, the jaw portion of the hand tool 10 is illustrated in an enlarged view with the handles 12 and 14 broken away. The solid lines in FIG. 3 indicate the relationship of the components of the preferred hand tool 10 when the jaws 18 and 20 are in their open positions. For comparison, the relationship of the preferred components when the jaws 18 and 20 are closed is indicated in broken lines. For purposes of illustration and convenient reference in the description of the preferred operation of the hand tool 10, the terms "downward" and "lower" as used herein relate to the direction toward the handles 10 and 12 as viewed in FIG. 3. Similarly, the terms "upward" and "upper" relate to the direction toward the free ends of the jaw members as viewed in FIG. 3. The invention is not, however, limited to any particular orientation.

As the handles 12 and 14 are urged toward each other from the open-jaw position by the operator of the hand tool 10, they function as levers pivoting about the common pin 16 to spread the pins 22 and 24 outwardly thereby spreading the lower ends 56 and 58 of jaw members 18 and 20 to bring their fulcrum points 60 and 62 into mutual engagement to form a common fulcrum point 64. Because of the great length of the handles 18 and 20 relative to the respective distances between the common pin 16 and the pins 22 and 24, a significant mechanical advantage is derived which results in a multiplication of the upward and outward forces at the pins 22 and 24. Such upward and outward forces on the pins 22 and 24 cause the jaw members 18 and 20 to continue to pivot toward each other about their common fulcrum point 64.

As the jaw members 18 and 20 pivot toward each other, the linkage pins 51 and 57 are pivotally urged upwardly and outwardly relative to the common fulcrum point 64 to the positions indicated as 51*a* and 57*a*. The linkage pins 51 and 55 are pivotally maintained a fixed distance apart by linkage plate 32, and the linkage pins 57 and 53 are pivotally maintained a fixed distance apart by the linkage plate 30. Likewise, the linkage pins 51 and 53 are maintained a fixed distance apart by jaw member 18 and the linkage pins 57 and 55 are maintained a fixed distance apart by jaw member 20. Because of such a relationship, the linkage pins 53 and 55 are pivoted inwardly and upwardly about the common fulcrum point 64 to the positions indicated as 53*a* and 55*a* as the jaw members 18 and 20 are pivoted to their closed positions 18*a* and 20*a*. Simultaneously, linkage plates 30 and 32 rotate clockwise and counter-clockwise, respectively, to their common closed-jaw position indicated by reference numeral 90. The rotations of the linkage plates 30 and 32 are guided or accommodated by the provision of the elongated apertures 44 and 46 at the opposite diagonal corners of the linkage plates 30 and 32. Similarly, the clockwise and counter-clockwise rotations of the linkage plates 34 and 36, respectively, which are not visible in FIG. 3, are accommodated or guided by the provision of the elongated apertures 44 and 46 at the opposite diagonal corners of the linkage plates 34 and 36.

As the linkage plates 30, 32, 34 and 36 each rotate in their respective directions when the jaw members 18 and 20 are pivoted, the locus described by each of the upper and lower edges of each of the linkage pins 51, 53, 55 and 57 is a straight line relative to their respective linkage plates. Thus, it has been found that the elongated apertures 44 and 46 should preferably be formed with generally parallel, straight sides oriented at a slight angle 66 relative to a reference line 67 perpendicular to the longitudinal operative centerline 68 of the mechanism when the jaw members 18 and 20 are closed. Although the angle 66 may vary depending upon the geometry and the jaw spread angle of the mechanism or device in which linkage assembly 26 is employed, the angle 66 has been found to be in the range of four to seven degrees for a device such as the hand tool 10 having a jaw spread angle of approximately 25 degrees.

The jaw members 18 and 20 are shown for purposes of illustration in the accompanying drawings as having straight, mating working surfaces 70 and 72, respectively. As actually produced, however, the jaw members 18 and 20 are formed with suitable mating die configurations for performing an operation on a workpiece. Such dies operatively engage the workpiece when the jaw members 18 and 20 are in their closed position. As the jaw members 18 and 20 are pivoted to their closed positions 18*a* and 20*a*, and the operator exerts an operating force on the handles 12 and 14 to impart a working force on a workpiece, a new common fulcrum point 80 is established at the free ends 82*a* and 84*a* of the jaw members 18 and 20, respectively. The operating force on the handles 12 and 14 causes a spreading force on the pins 22 and 24 which in turn results in a reactive force being exerted primarily on each of the linkage pins 51 and 57 by the jaw members 18 and 20. Such reactive forces tend to cause the linkage pins 51 and 57 to bend or bow laterally. Because each of the linkage pins 51 and 57 are pivotally linked to each of the linkage pins 55 and 53 by the linkage plates 30, 32, 34 and 36 and by the jaw members 18 and 20, the operating force on the handles 12 and 14 also results in a reactive force on the linkage pins 53 and 55, tending to cause a lateral bending or bowing of these linkage pins as well. If excessive, such bowing or bending of the linkage pins 51, 53, 55 and 57 may cause misalignment of the dies or working surfaces of the jaw members 18 and 20. The sides of the elongated apertures 44 and 46 in the linkage plates 30, 32, 34 and 36 provide additional lateral support for the linkage pins 51, 53, 55 and 57 thereby minimizing the lateral bending or deflection of the linkage pins by more evenly distributing the reactive forces among them. Thus, at least when an operation is being performed on a workpiece, the linkage pins 51, 53, 55 and 57 are in load-bearing or load-transferring engagement with the sides of the elongated apertures 44 and 46.

As the jaw members 18 and 20 are pivoted to their closed positions 18*a* and 20*a* and an operating force is applied to the handles 12 and 14, the reactive forces on the linkage pins 53 and 55 tend to cause downwardly and inwardly directed forces to be exerted on the working surfaces 70 and 72 of the jaw members 18 and 20, respectively. Such forces resist any tendency of the jaw members 18 and 20 to pivot outwardly about the new common fulcrum point 80 as the work operation is performed, thereby maintaining the working surfaces 70 and 72 in their proper work-performing alignment and maintaining the required inwardly directed force on the workpiece.

A preferred embodiment of the invention is illustrated in FIGS. 1 through 3 and described above. One skilled in the art will readily recognize from the foregoing description that alternative embodiments of the invention may be employed where appropriate. For example, for lighter applications where less lateral support is required for the linkage pins, only a single pair of linkage plates may be needed. The pair of linkage plates should, however, be oriented in a reversed relationship to each other, as are the linkage plates 30 and 32, or the linkage plates 32 and 34, for example. Such reversed relationship is preferred in order to obtain the same relative pivotal motion of the jaw members 18 and 20 as is described above for the hand tool 10 illustrated in FIGS. 1 through 3. The single pair of linkage plates preferably should be located on opposite sides of the jaw members 18 and 20, however, in order to balance the lateral forces on the ends of the linkage members, thereby tending to maintain proper jaw member alignment.

One skilled in the art will also readily recognize from the above description that any greater number of linkage plates may be employed on each side of jaw members 18 and 20 where the working forces are large and additional support for the linkage pins is required. In such a multiple plate arrangement, however, the number of plates on each side of the jaw members should preferably be equal, and each linkage plate should be oriented in the above-described reverse relationship relative to its adjacent linkage members. Such a configuration and orientation is preferred in order to balance the pin support on both sides of the jaw members and maintain proper jaw alignment.

Figure 4:
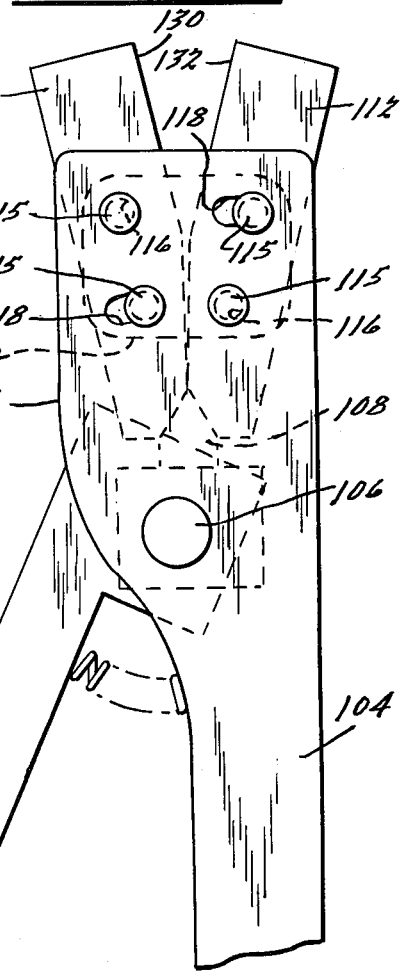
FIG. 4 is a side view of a hand tool including an alternate embodiment of the invention.
Figure 5:
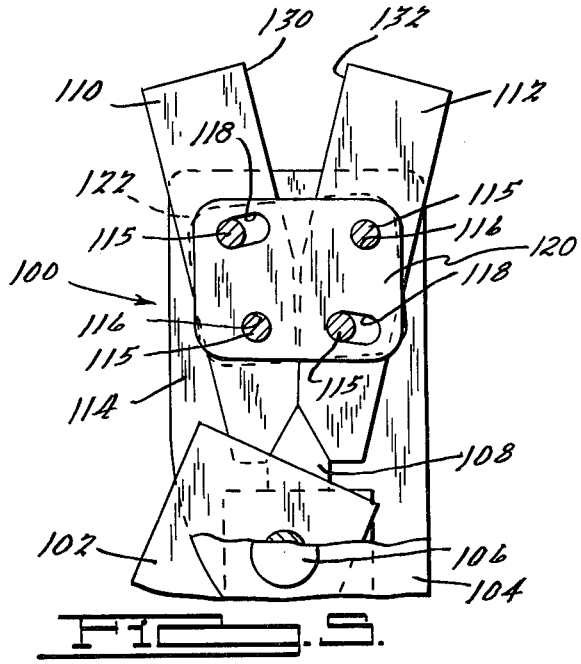
FIG. 5 is a side view of the hand tool of FIG. 4 with a portion of the frame broken away.

FIGS. 4 and 5 illustrate another alternate embodiment of the invention wherein two of the linkage plate structures are incorporated into the frame or actuating apparatus of the mechanism. A hand tool 100 shown in the drawings for purposes of illustration only, includes a pair of actuating handles or levers 102 and 104 pivotally interconnected by a pin 106. The handle 102 includes a pivotal wedge-shaped cam 108 thereon for spreadably engaging the inner ends of a pair of pivotal jaw members 110 and 112. The jaw members are pivotally connected between the legs of a U-shaped frame portion 114 of the hand tool 100 by linkage pins 115 extending through pivot apertures 116 and elongated apertures 118 in each of the identical legs of frame portion 114.

The hand tool 100 also includes a pair of linkage plates 120 and 122 disposed on opposite sides of the jaw members 110 and 112. The linkage plates 120 and 122 also have pivot apertures 116 and elongated apertures 118 extending therethrough for receiving the linkage pins 115 therein. The pivot apertures 116 and the elongated apertures 118 of the linkage plates 120 and 122 are oriented in a reversed relationship relative to those of the legs of the frame portion 114.

As the handles 102 and 104 are urged toward each other, cam 108 spreads the inner ends of jaw members 110 and 112, causing their working surfaces 130 and 132 to converge to a closed position. Simultaneously, the linkage plates 120 and 122 rotate as is described above for the preferred embodiment, thereby imparting a relative pivotal motion to the jaw members 110 and 112 and providing lateral support for the linkage pins 115 similar to that described above.

Alternatively, the jaw member 112 and the linkage pins 115 may be fixed relative to the frame portion 114, with the jaw member 110 pivoting relative thereto if desired in a particular tool mechanism or other device in which the invention is to be applied. In such an embodiment of the invention, the linkage plates 120 and 122 rotate as described above when the handles 102 and 101 are urged toward or away from each other, thereby imparting the above-described relative pivotal motion to the jaw members 110 and 112.

The foregoing descriptions represent merely exemplary embodiments of the present invention. From such descriptions, one skilled in the art can readily visualize many other alternative embodiments, configurations and applications of the invention illustratively described herein. Thus, various changes or modifications may be made in the above-described embodiments without departing from the spirit or scope of the following claims.

I claim:

1. In a mechanism having a pair of elements relatively pivotal between a first position and a second position, said mechanism including at least one pair of linkage members, the improvement wherein said linkage members are movable relative to one another, each of said linkage members including pivot means for pivotally interconnecting said pair of relatively pivotal elements and including support means for supporting the pivot means of the other of said linkage members, each of said pivot means including at least a pair of pivot pins extending through one of said elements and at least a pair of corresponding generally circular pivot apertures extending through at least said one of said elements for pivotally receiving said pair of pivot pins, and each of said support means including a pair of elongated openings for receiving the pair of pivot pins of the other of said pivot means therein.

2. The improvement according to claim 1, wherein each of said pivot pins of each pivot means abuttingly engages a peripheral edge of its respective elongated opening in the other of said support means at least when said elements are in said first position.

3. the improvement according to claim 1, wherein each of said pivot pins of each pivot means slidably engages a peripheral edge of its respective elongated opening in the other of said support means as said elements pivot between said first and second positions.

4. In an apparatus having a pair of levers pivotally interconnected by at least a pair of cross link members, each of said cross link members being pivotally attached to said levers by pivot pins, the improvement wherein each of said cross link members is pivotally attached to both of said levers by separate pivot pins, each of said pivot pins of each cross link member extending through both of said cross link members and being attached to only one of said levers, said cross link members being movable relative to one another as said levers are pivoted with respect to one another, each of said cross link members further including guide means separate from said levers for reinforcing the pivot pins of the other of said cross link members, thereby tending to counter-balance the forces exerted on said pivot pins by said levers.

5. The improvement according to claim 4, wherein each of said guide means comprises elongated apertures extending through a portion of each cross link member for slidably receiving the pivot pins of the other cross link member.

6. In a tool having a pair of jaw members relatively pivotal between an open position and a closed position, said jaw members having working surfaces thereon for operatively engaging a workpiece to perform an operation thereon when urged into said closed position, said tool including at least one pair of generally plate-shaped linkage members pivotally interconnecting said jaw members, each of said linkage members having a pair of pivot apertures extending therethrough for pivotally receiving a pair of pivot pins therein, said pivot pins being pivotally received in a pair of corresponding openings extending through said jaw members, the improvement wherein each of said linkage members includes a pair of elongated apertures extending therethrough, each pair of said elongated apertures receiving the pivot pins of the other of said linkage members therein, a peripheral edge of each of said elongated apertures abuttingly engaging and supporting the respective pivot pin of the other of said linkage member at least when said jaw members operatively engage said workpiece.

7. The improvement according to claim 6, wherein said pivot pins extending through said linkage members exert reactive forces on said jaw members when said jaw members are urged into said closed position, said reactive forces acting in a direction so as to maintain said working surfaces in operative engagement with said workpiece.

8. The improvement according to claim 6 or 7, wherein said linkage members pivot relative to each other.

9. The improvement according to claim 8, wherein said pivot apertures and said elongated apertures are arranged in a generally rectangular array in each of said linkage members, said elongated apertures being located at diagonally opposite positions in said generally rectangular array.

10. The improvement according to claim 9, wherein said linkage members are identical but reversed relative to each other.

11. The improvement according to claim 10, wherein said tool includes a plurality of pairs of linkage members, with an equal number of said linkage members being adjacently disposed on opposite sides of said jaw members in face-to-face mutual engagement, each of said linkage members being oriented in said reversed relationship relative to its adjacent linkage members.

12. A tool comprising a pair of actuating levers pivotally connected to each other and to a pair of jaw members, said jaw members relatively pivotal between an open position and a closed position in response to relative pivotal movement of said actuating levers, said jaw members having working surfaces thereon for operatively engaging a workpiece to perform an operation thereon when urged into said closed position, said tool including at least one pair of generally plate-shaped cross link members pivotal relative to each other and pivotally interconnecting said jaw members, each of said cross link members having a pair of pivot apertures extending therethrough for pivotally receiving a pair of pivot pins therein, said pivot pins being pivotally received in a pair of corresponding openings extending through said jaw members, each of said cross link members including a pair of elongated apertures extending therethrough, each pair of said elongated apertures receiving the pivot pins of the other of said cross link members therein, said pivot apertures and said elongated apertures being arranged in a generally rectangular array in each of said cross link members with said elongated apertures being located at diagonally opposite positions in said array, said cross link members being identical but disposed in reversed relationship relative to each other such that each of said pivot pins is received by a pivot aperture of one of said cross link members and an elongated aperture of the other of said cross link members, a peripheral edge of each of said elongated apertures abuttingly engaging and supporting the respective pivot pin of the other of said cross link member at least when said jaw members operatively engage said workpiece, said pivot pins exerting reactive forces on said jaw members when said jaw members are urged into said closed position, said reactive forces acting to urge said working surfaces toward each other in operative engagement with said workpiece.

13. A tool comprising a pair of actuating levers pivotally connected to each other and to a pair of jaw members, said pair of jaw members relatively pivotal between an open position and a closed position in response to relative pivotal movement of said actuating levers, said jaw members having working surfaces thereon for operatively engaging a workpiece to perform an operation thereon when urged into said closed position, said tool including at least a pair of generally plate-shaped cross link members pivotal relative to each other and pivotally interconnecting said jaw members, each of said pair of cross link members being disposed on opposite sides of said jaw members, each of said cross link members having a pair of pivot apertures extending therethrough for pivotally receiving a pair of pivot pins therein, said pivot pins being pivotally received in a pair of corresponding openings extending through said jaw members, each of said cross link members including a pair of elongated apertures extending therethrough, each pair of said elongated apertures receiving the pivot pins of the other of said link members therein, said pivot apertures and said elongated apertures being arranged in a generally rectangular array in each of said cross link members with said elongated apertures being located at diagonally opposite positions in said array, said cross link members being identical but disposed in a reversed relationship relative to each other such that each of said pivot pins is received by a pivot aperture of one of said cross link members and an elongated aperture of the other of said cross link members, a peripheral edge of each of said elongated apertures abuttingly engaging and supporting the respective pivot pin of the other of said cross link member at least when said jaw members operatively engage said workpiece, one of said actuating levers including a portion thereof generally U-shaped portion in cross-section with one leg of said U-shaped disposed on each of the opposite sides of said jaw members adjacent one of said cross-link members, each said legs also including a pair of pivot apertures and a pair of elongated apertures arranged in a generally rectangular array with said elongated apertures being located at diagonally opposite positions in said array, the positions of said pivot apertures and said elongated apertures in said array on each of said legs being reversed relative to each other and relative to its adjacent cross link member, said pivot pins also being received within said corresponding pivot apertures and elongated apertures of said legs of said actuating lever, a peripheral edge of each of said elongated apertures in each of said legs abuttingly engaging and supporting the respective pivot pin of the other of said leg at least when said jaw members operatively engage said workpiece, said pivot pins exerting reactive forces on said jaw members when said jaw members are urged into said closed position, said reactive forces acting to urge said working surfaces toward each other in operative engagement with said workpiece.

* * * * *

UNITED STATES PATENT AND TRADEMARK OFFICE

CERTIFICATE OF CORRECTION

PATENT NO. : 4,441,388

DATED : April 10, 1984

INVENTOR(S) : Henry A. Manor

It is certified that error appears in the above-identified patent and that said Letters Patent is hereby corrected as shown below:

Column 2, line 33, "31" should be -- 34 --.

Column 2, line 40, "face-to face" should be --
-- face-to-face --.

Column 5, line 50, "101" should be -- 104 --.

Signed and Sealed this

*Thirteenth* Day of *November 1984*

[SEAL]

*Attest:*

GERALD J. MOSSINGHOFF

*Attesting Officer*

*Commissioner of Patents and Trademarks*